United States Patent [19]

Forry et al.

[11] 4,435,353

[45] Mar. 6, 1984

[54] PROCESSES FOR FORMING BUILDING MATERIALS COMPRISING NON-WOVEN WEBS

[75] Inventors: John S. Forry, Manor Township, Lancaster County; John R. Garrick, Lancaster, both of Pa.

[73] Assignee: Armstrong World Industries, Inc., Lancaster, Pa.

[21] Appl. No.: 408,060

[22] Filed: Aug. 16, 1982

[51] Int. Cl.[3] ..... B29C 5/00

[52] U.S. Cl. ..... 264/518; 264/113

[58] Field of Search ..... 264/518, 113

[56] References Cited

U.S. PATENT DOCUMENTS 3,356,780 12/1967 Cole ..... 264/518

4,146,564 3/1979 Garrick et al. ..... 264/113

4,375,448 3/1983 Appel et al. ..... 264/518

*Primary Examiner*—James R. Hall

*Attorney, Agent, or Firm*—Laird F. Miller

[57] ABSTRACT

A mixture of binder and fibrous material is introduced into the upper regions of a mat-forming zone. The mixture is intersected by a horizontally or upwardly directed air stream and entrained therein, then layered onto at least one foraminous wire by exhausting the entraining air through said foraminous wire or wires. By reducing turbulence and by controlling the manner in which the particulate matter is deposited upon the foraminous wires, uniform non-woven webs can be obtained which may be used in a variety of ways to form versatile building products.

20 Claims, 4 Drawing Figures

PROCESSES FOR FORMING BUILDING MATERIALS COMPRISING NON-WOVEN WEBS

The present invention relates to building products and more particularly to apparatus and processes for making building products comprising non-woven webs or mats.

BACKGROUND OF THE INVENTION

Techniques of forming non-woven webs from substantially dry components have long been recognized in the art; however, with the advent of high energy costs, the desirability of using such techniques rather than wet-forming processes has become even more evident. Nevertheless, substantial problems have been encountered in preparing dry-formed web materials having a relatively uniform structure. This invention concerns certain special apparatus and processes which may be utilized to prepare such uniform non-woven webs, as well as products comprising these webs.

THE PRIOR ART

Several patents are of particular interest in relation to the present invention. U.S. Pat. No. 3,356,780 disclosed apparatus for making fabric. A mixture of fibrous particles and binder was fed into a chamber where it was contacted with a rapidly rotating cylinder and a pressurized air stream. The rapidly rotating cylinder and air hurled the fibers toward slowly rotating foraminous cylinders which had an interior vacuum. The fibers and binder were matted onto the cylinders which rolled together to form a layered fibrous material. U.S. Pat. Nos. 4,097,209 and 4,146,564, both of which issued to J. R. Garrick et al., concerned apparatus and a process, respectively, for forming a mineral wool fiberboard product. A mixture of mineral wool fiber and binder was prepared and fed through a venturi into a relatively high velocity air stream such that the mixture of material was entrained and carried to a mat-forming zone. In the mat-forming zone the material was layered onto converging foraminous wires by exhausting the air through the foraminous wires. The wires were then converged to give a mineral wool fiberboard product. Unfortunately, the processes and apparatus of Garrick et al. possessed features which essentially restricted them to the production of relatively thick gauge materials which had highly variable basis weights.

Accordingly, one objective of the present invention is to provide apparatus and processes to produce non-woven webs and other building materials having uniform basis weights.

Another objective of the present invention is to provide composite sandwich-like building materials which can be structurally varied as desired to provide good acoustical properties or good strength characteristics.

Yet another objective of the present invention is to provide apparatus and processes which are more versatile than the apparatus and processes presently known in the art.

These and other objectives of the present invention will become apparent from the description of preferred embodiments which follows.

SUMMARY OF THE INVENTION

Figure 1:
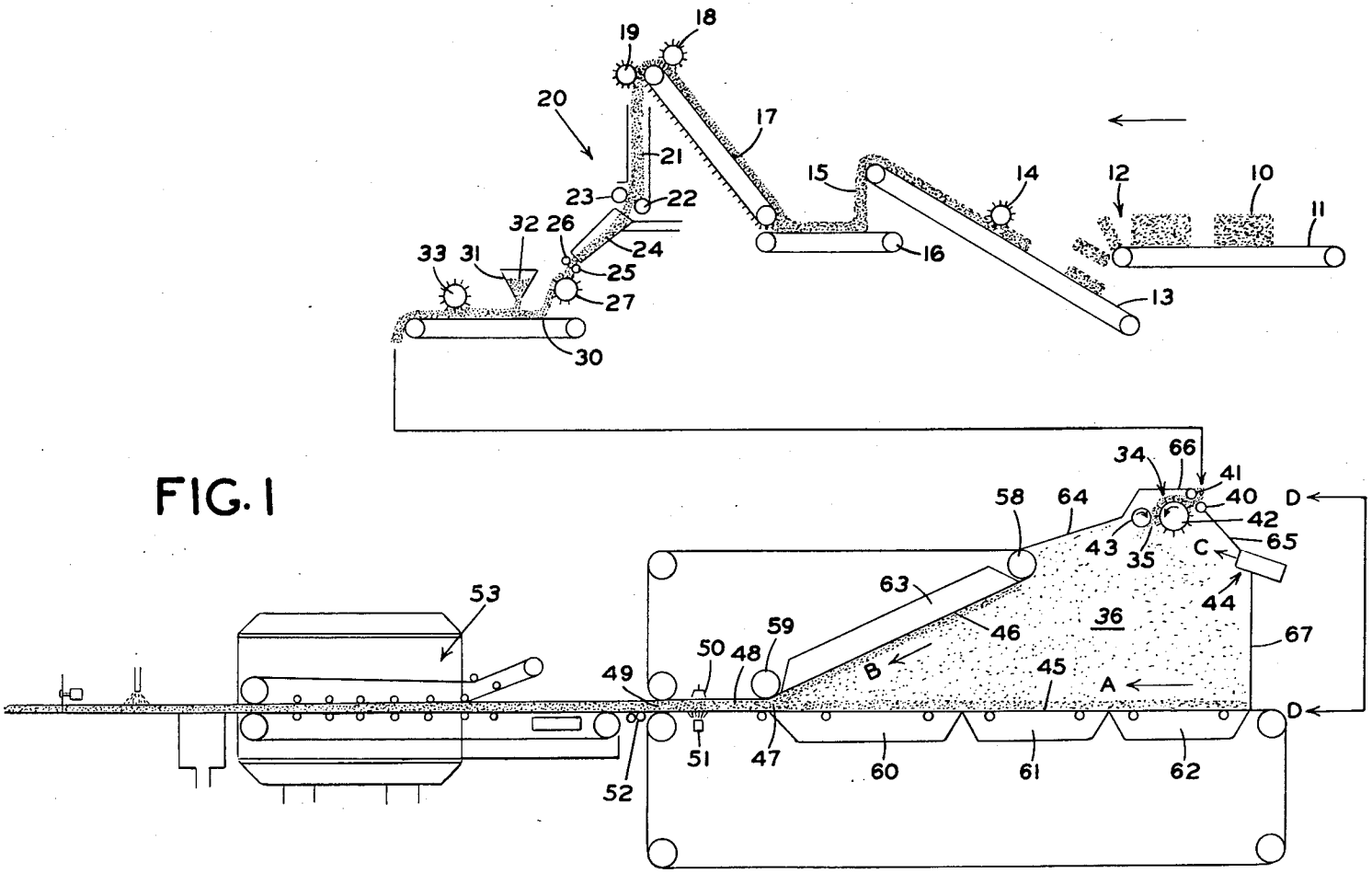
FIG. 1 illustrates apparatus for preparing a non-woven web of the present invention, said apparatus comprising means for preparing a mixture comprising binder and fibrous material, a mat-forming zone and means for processing the mat which is produced.

A mixture of binder and fibrous material is introduced into the upper regions of a mat-forming zone. The mixture is intersected by a horizontally or upwardly directed air stream and entrained therein, then layered onto at least one foraminous wire by exhausting the entraining air through said foraminous wire or wires. By reducing turbulence and by controlling the manner in which the particulate matter is deposited upon the foraminous wires, uniform non-woven webs can be obtained which may be used in a variety of ways to form versatile building products.

DETAILED DESCRIPTION OF PREFERRED EMBODIMENT

In one embodiment the present invention comprises a process for forming a non-woven web, said process comprising the steps of preparing a mixture comprising a binder and principally inorganic fibrous material; introducing said mixture into the upper regions of a mat-forming zone comprising a first moveable foraminous wire disposed in the lower region thereof and, optionally, a second moveable foraminous wire disposed so as to converge with said first foraminous wire at a nip opening disposed therebetween, said mixture being introduced through a first aperture such that it falls into and is entrained in a horizontally or upwardly directed air stream which is introduced through a second aperture into said mat-forming zone, said second aperture having means associated therewith for controlling the direction of the air which passes therethrough; adjustably exhausting the entraining air through said wire or wires to selectively deposit said mixture thereupon, said second aperture and said optional second foraminous wire being disposed relative to said first foraminous wire such that the mixture which is deposited on said wire or wires is deposited essentially uniformly; consolidating said deposited mixture to yield a non-woven web of material; and compressing and curing said material.

In a second embodiment the present invention comprises a process for forming a building board comprising a core material and non-woven outer surfaces, said process comprising the steps of preparing a first mixture and a second mixture comprising a binder and principally inorganic fibrous material; introducing said first mixture into the upper regions of an upper mat-forming zone and said second mixture into the upper regions of a lower mat-forming zone, each said mat-forming zone comprising a first moveable foraminous wire disposed in the lower region thereof and, optionally, a second moveable foraminous wire disposed so as to converge with said first foraminous wire at a nip opening disposed therebetween, each said mixture being introduced through a first aperture such that it falls into and is entrained in a horizontally or upwardly directed air stream which is introduced through a second aperture into each said mat-forming zone, said second apertures having means associated therewith for controlling the direction of the air which passes therethrough; adjustably exhausting the entraining air through said first foraminous wires and said optional second foraminous wires to selectively deposit said mixtures thereupon, said second apertures and said optional second wires being disposed relative to said first foraminous wires such that the mixtures which are deposited on said wires are deposited essentially uniformly; consolidating the deposited mixtures to provide upper and lower webs of material; depositing a core mixture comprising a filler and a binder on said lower web of material; consolidating the resulting layered material with said upper web to provide a composite structure; and compressing and curing said composite structure.

In a third embodiment the present invention comprises apparatus for forming a non-woven web, said apparatus comprising (A) preparation means for preparing a mixture comprising a binder and principally inorganic fibrous material; (B) a mat-forming zone feedibly associated with said preparation means so as to receive said mixture, said mat-forming zone comprising (1) a first aperture in the upper regions thereof, said aperture comprising means for introducing said mixture therethrough, (2) a second aperture disposed therein such that air introduced through said second aperture is horizontally or upwardly directed so as to intersect and entrain therein said mixture, said second aperture having means associated therewith for controlling the direction of the air which passes therethrough, (3) a first moveable foraminous wire disposed in the lower region of said mat-forming zone, said wire exiting said mat-forming zone through a nip opening, and, optionally, a second moveable foraminous wire disposed so as to converge with said first foraminous wire at said nip opening, said optional second foraminous wire and said second aperture being disposed relative to said first foraminous wire such that said mixture is deposited essentially uniformly on said wires, (4) means for adjustably exhausting the entraining air through said foraminous wires to selectively deposit said mixture thereupon, and (5) means for moving said first foraminous wire and said optional second foraminous wire to said nip opening to form a non-woven web of material; and (C) means for consolidating said web and setting said binder.

In a fourth embodiment, the present invention comprises apparatus for forming a building material comprising a binder and principally inorganic fibrous material, said apparatus comprising (A) preparation means for preparing at least one mixture comprising a binder and principally inorganic fibrous material; (B) a first and a second mat-forming zone, each said zone being feedibly associated with a preparation means so as to receive a mixture therefrom and comprising (1) a first aperture in the upper region thereof, said aperture comprising means for introducing said mixture therethrough, (2) a second aperture disposed therein such that air introduced through said second aperture is horizontally or upwardly directed so as to intersect and entrain therein said mixture, said second aperture having means associated therewith for controlling the direction of the air which passes therethrough, (3) a first moveable foraminous wire disposed in the lower region of said mat-forming zone, said wire exiting said mat-forming zone through a nip opening, and, optionally, a second moveable foraminous wire disposed so as to converge with said first foraminous wire at said nip opening, said optional second foraminous wire and said second aperture being disposed relative to said first foraminous wire such that said mixture is deposited essentially uniformly on said wires, (4) means for adjustably exhausting the entraining air through said foraminous wires to selectively deposit said mixture thereupon, (5) means for moving said first foraminous wire and said optional second foraminous wire to said nip opening, and (6) means for consolidating the deposited material to provide a non-woven web of material, (C) means for converging the non-woven webs formed by said first and second mat-forming zones; and (D) means for consolidating said webs and setting said binders.

In a fifth embodiment, the present invention comprises a building board comprising a core material and non-woven outer surfaces, said board being obtained by forming two non-woven webs comprising binder and principally inorganic fibrous material; disposing a core mixture comprising a binder and a filler between said webs; consolidating said webs and said core mixture to provide a composite structure; and compressing and curing said structure.

The apparatus disclosed in U.S. Pat. No. 4,097,209 has proved useful to produce mineral wool products having a thickness of about one inch or more. Although particle clumping and the presence of wave patterns have caused some difficulties, these difficulties have not been particularly significant because the resulting product was intended to be of thick gauge. However, where thinner gauge products were desired, problems associated with the presence of clumps and waves proved to be virtually insurmountable.

Applicants herein have discovered that the primary cause of these problems is the sequential process of entraining the particulate matter in the air stream and then subsequently introducing the entrained mixture into the mat-forming zone. A rapid air flow is required in order to maintain entrainment. The feed mechanism which separates the bulk solids into individual particles and introduces them into the air stream tends to develop a static charge on the particles. The rapid air flow in combination with the static charge results in turbulence and particulate clumping. Small clumps of material initially form on the walls of the venturi, as well as in the forming chamber. As the clumps collect more material, two effects are obtained. First, the clumps periodically break loose and are deposited on the foraminous wires. Secondly, the clumps tend to channelize the passing air, thus causing non-uniform entry of the particulate matter into the mat-forming zone. This latter effect, in combination with the rapid entry of the entrained material into the mat-forming zone and across the surfaces of the foraminous wires, tends to cause uneven deposition and wave patterns in material which is deposited on the wires. Thus, the entrainment process is virtually precluded where uniform basis weights are desired.

Surprisingly, applicants have discovered that remarkable improvements in basis weight uniformity can be achieved by separately introducing the particulate matter and the air stream into the mat-forming zone, and by making other significant changes in the prior art process. By variably directing the air stream horizontally or preferably upwardly into the particulate matter which is introduced through an aperture located in the upper regions of the mat-forming zone such that the particulate matter intersects and is entrained in the air stream, and by locating the foraminous wires and apertures in relation to one another such that the entrained particles tend not to pass with high velocity in a parallel fashion across the surfaces of the foraminous wires prior to deposition, non-uniform deposition problems are dramatically reduced. As a result, uniform webs having uniform basis weights and thicknesses on the order of 40 mils can be routinely produced.

Apparatus which is preferred to practice the present invention is illustrated in FIG. 1. Several features thereof were disclosed in U.S. Pat. No. 4,097,209, especially the means for preparing the particulate mixture and the curing and finishing means. Mineral wool is typically received in bales 10 which must be fragmented for use. FIG. 1 illustrates bales 10 residing on conveyor 11. The bales are partially fragmented at 12, transferred to inclined conveyor 13 and then passed under flail 14 which causes initial separation of bales 10 into fibers 15. From conveyor 13, fibers 15 fall onto conveyor 16 and are then fed onto inclined pinned feeder conveyor 17. At the top of conveyor 17 the fibers are combed by rotary comb 18, thereby leveling the feed. The feed is doffed by roll 19 into a gravimetric feeding device 20 comprising chute 21, compression rolls 22 and 23, and flow rate scale 24. Device 20 then passes fibers 15 through feed rolls 25 and 26 onto fluffing roll 27. Fluffing roll 27 drops fibers 15 onto conveyor 30 which conducts them beneath a binder adding station 31. Binder adding station 31 also comprises a gravimetric feeding device (not illustrated) and it deposits a desired amount of binder 32 onto fibers 15 carried onto conveyor 30. The layered fibers 15 and binder 32 are mixed with fluffing roll 33 and then passed into fiberizing device 34 of first aperture 35 of mat-forming zone 36. Fiberizing device 34 comprises feed rolls 40 and 41, lickerin roll 42 and doffing brush 43.

Mat-forming zone 36, excluding wires 45 and 46, is constructed where possible of material which is substantially electrically non-conductive, such as plexiglass. Although certain metal pieces are needed for structural or other purposes, electrically conductive surfaces tend to cause a plating out of static-charged particles on those surfaces. Thus, they are to be avoided whenever possible. Foraminous wires commonly are constructed of a conductive material and the use of such material for lower wire 45 is preferred. However, more latitude is permitted with upper wire 46 and it may be constructed of a non-conductive material, such as plastic. Air enters mat-forming zone 36 through second aperture 44 and entrains the mixture of mineral wool and binder. The entrained mixture is then felted onto first foraminous wire 45 and second foraminous wire 46 as hereinafter described. Wires 45 and 46 are brought together at nip opening 47, at which point the felted mixture is consolidated in consolidation zone 48. Prior to exiting from consolidation zone 48 at opening nip 49, an upper tamping device 50 and a lower antistatic device 51 assist in the separation of the consolidated material from the foraminous wires. The consolidated material passes across transfer rolls 52 and into oven 53, where it may then be dried, cured and the like.

Although mat-forming zone 36, as illustrated, comprises first foraminous wire 45 and second foraminous wire 46, which are preferred, it must also be noted that, in certain instances, it may be possible to dispense with second foraminous wire 46. Thus, wire 46 could be replaced, for example, by a panel of non-conductive material or a non-foraminous wire. Non-woven webs produced using apparatus comprising only one foraminous wire might, in some cases, have relatively more random particle size distributions than webs produced using apparatus comprising two such wires. Nevertheless, in many instances, and particularly when producing cored building boards, the random distribution of particles makes little difference in the resulting product.

When such modifications are employed, other changes to the apparatus will also be required. For example, if second wire 46 is replaced by a panel, consolidation of the felted web could most conveniently be accomplished at nip opening 47 using a seal roll. Further, the absence of an upper wire in consolidation zone 48 would, in most instances, obviate the need for tamping device 50, whose primary function is to assist in separating the web from said upper wire.

Figure 2:
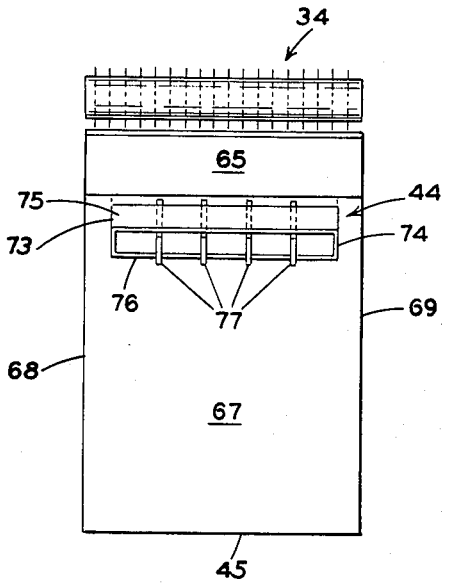
FIG. 2 illustrates an end view of a mat-forming zone of the present invention taken along lines D—D of FIG. 1.

With the preferred arrangement illustrated in the figures, wire 45 passes in direction A through the lower region of mat-forming zone 36, whereas wire 46 enters mat-forming zone 36 by passing around wire roll 58, moves in direction B toward nip opening 47 and leaves mat-forming zone 36 by passing around wire roll 59. Foraminous wires 45 and 46 comprise means 60 to 63 to exhaust air through said wires. Mat-forming zone 36 also comprises ceiling sections 64 and 65, shroud 66 which houses fiberizing device 34, back panel 67, and side panels 68 and 69 (FIG. 2).

Second aperture 44 is disposed in back panel 67 and is directed upwardly such that air introduced into mat-forming zone 36 through said aperture generally passes in direction C. It is also possible to have air entering through aperture 44 in a horizontal manner; however, less satisfactory felting is achieved with a horizontal configuration. Further, as a note of caution, downwardly directing the air through aperture 44 should be avoided because extremely poor results are often obtained.

Although the preferred arrangement illustrated in the figures shows apertures 35 and 44 as individual openings, the present invention also contemplates those devices which, because of size or other considerations, comprise multiple apertures which introduce particulate matter or air into the mat-forming zone. Accordingly, the use of singular terminology herein will be deemed to include a plurality of the indicated device.

Figure 3:
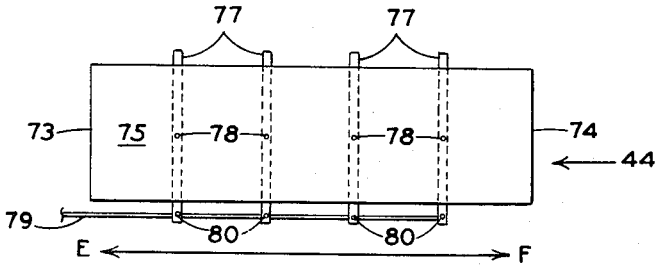
FIG. 3 illustrates a plan view of a preferred aperture through which air enters a mat-forming zone.

Preferably, second aperture 44 will also comprise means to variably control the direction of the incoming air as it enters mat-forming zone 36. Oscillating vanes have proved to be especially suitable and are illustrated in FIGS. 2 and 3, FIG. 2 being taken along lines D—D of FIG. 1, and FIG. 3 being a plan view of second aperture 44.

Second aperture 44 is comprised of side panels 73 and 74, top panel 75, and bottom panel 76, the two ends of said aperture being open. Disposed within said aperture is a series of vanes 77. Vanes 77 are mounted on pins 78 which are rotatively contacted with top panel 75 and bottom panel 76 such that vanes 77 pivot about the axes of pins 78. The ends of vanes 77 lying furthest from mat-forming zone 36 are connected to a vane oscillating shaft 79 by oscillator shaft connectors 80. Although the illustrated vane arrangement has proved to be particularly suitable to control the direction of air flow, other flow control means disposed in or behind second aperture 44 or in mat-forming zone 36 may also be used to advantage. Thus, all such flow control means are contemplated by the present invention.

In operation, first foraminous wire 45 and second foraminous wire 46 are moved in directions A and B (FIG. 1), respectively, so that they converge at nip opening 47. Exhaust means 60, 61 and 62 draw air from mat-forming zone 36 through said first foraminous wire, and exhaust means 63 draws air through said second foraminous wire. The exhausted air is replaced by air entering the mat-forming zone through second aperture 44. Thus, a negative pressure is always maintained in mat-forming zone 36.

Mineral wool is the preferred inorganic fibrous material which will be used to practice the present invention; however, other fibers may also be included. Examples of such materials are inorganic fibers such as glass, ceramic and wollastonite; natural fibers such as cotton, wood fibers, or other cellulosic materials; and organic fibers such as polyester or polyolefins. In addition, other materials such as perlite and various clays may also be included.

When a mixture of binder and principally inorganic fibrous material is introduced through first aperture 35, it is intersected by the upwardly directed air entering through second aperture 44. The vane arrangement of second aperture 44 variably channelizes the air, and aperture 44 preferably is directed so that the air intersects the mixture of material immediately below first aperture 35. The resulting entrained mixture of material is deposited on first and second foraminous wires 45 and 46 as the entraining air is exhausted through said wires. The manner in which air is exhausted through said wires may be varied as desired by the artisan to obtain products having various characteristics. Although a single exhaust means may be utilized behind each wire, the figures illustrate multiple exhaust means 60, 61 and 62 disposed below first foraminous wire 45. Thus, air exhaustion may be varied in two ways; namely, by varying the amount exhausted through different areas of a single wire, e.g., via means 60, 61 and 62, and by varying the relative amounts which are exhausted through the upper and lower wires 46 and 45.

Fine particles which are lighter than big particles tend to follow the air stream and hence tend to be felted on those portions of the wires through which the majority of the air is exhausted. Thus, for example, if 90% of the air is being exhausted through one wire, the majority of the fine particles will be deposited on that wire. As another consideration, stratification and basis weight control will also be affected by variably exhausting the air through different portions of a single wire. It should therefore be apparent that, where thin-gauge webs are desired, variable exhaustion of the air via means 60, 61 and 62 is very advantageous. In such circumstances, the majority of the air is preferably exhausted through wire 45 toward the back of the mat-forming zone by use of exhaust means 62, with lesser amounts being exhausted using exhaust means 60 and 61. Variable exhaustion is another way of avoiding turbulent passage of the entrained material across the surface of wire 45 near nip opening 47, the implications of which are referred to below.

Variable air exhaustion also provides an alternative to the replacement of second foraminous wire 46 by a panel or a non-foraminous wire. Thus, by merely turning off the exhaust means behind wire 46, essentially all of the air would be exhausted through first foraminous wire 45. However, this alternative is not entirely satisfactory because, even when all of the air passes through wire 45, certain of the particulate matter tends to stick to wire 46, leading to some gauge variation in the resulting product.

One significant drawback of the apparatus disclosed in U.S. Pat. No. 4,097,209 was the lack of uniformity of the material obtained. A number of factors which contributed to the non-uniformity have been set forth above; however, another factor which has not been mentioned is the narrow angle of incidence between the converging foraminous wires. Because of this narrow angle, when the entrained material entered the mat-forming zone, the particulate matter tended to sweep with high velocity across the surfaces of the foraminous wires. This turbulent passage was compounded by the static charges present on the entrained material, resulting in wave patterns in the deposited material.

For these reasons, the angle between wires 45 and 46 at nip opening 47 should be such that a turbulent passage of the entrained material across the surfaces of said wires is avoided. The angle illustrated at the nip opening of the apparatus described in U.S. Pat. No. 4,097,209 is about 12 degrees; however, it has been found with the present invention that angles of not less than about 20 degrees are preferred. Furthermore, the angle should not be too great because any material deposited on wire 46 will tend to crack or fall off the wire as it passes around wire roll 59, especially if thick mats are being produced. Accordingly, a maximum angle of not more than about 55 degrees is preferred.

In addition to the horizontal or upward introduction of air through second aperture 44, which was referred to earlier, another factor which affects the manner in which the particulate matter is deposited upon said foraminous wires is the location at which second aperture 44 is disposed in back panel 67. If the point of intersection of the incoming air and the particulate matter is too far below aperture 35, suitable entrainment may not occur and the particulate matter may tend to pass across first foraminous wire 45 at a relatively flat angle. Both effects tend to encourage wave patterns and non-uniformity. Accordingly, it is preferred that second aperture 44 be disposed in the upper portions of back panel 67. Similar problems can also be encountered if second aperture 44 is downwardly directed into the particulate material, or if it is too far away from first aperture 35. For apparatus constructed as illustrated in the figures and having approximate dimensions as hereinafter described, we have found that the best results are obtained if the distance between first aperture 35 and first foraminous wire 45 is not less than 36 inches, and if the distance between the inner end of second aperture 44 and the point where the upwardly directed air stream intersects the mixture of material is approximately 24 inches.

Although these results may also be varied somewhat by increasing the angle at nip opening 47, this angle and the disposition of second aperture 44 may both be varied to achieve the same result. Accordingly, it should be kept in mind that it is desired that the particulate matter approach the surfaces of said foraminous wires 45 and 46 in a non-turbulent and approximately non-parallel manner.

The vanes disposed in second aperture 44 provide a particularly valuable contribution to the present invention. The build-up of wave patterns with time in the prior art apparatus was due in part to channelization caused by the static-induced deposition of the particulate materials in various parts of the passage through which the entrained material passed, and in part to the manner in which the entrained material passed across the material which had previously been felted on the foraminous wires. Vanes 77 tend to eliminate this problem by oscillating back and forth. As shaft 79 oscillates back and forth generally along path EF (FIG. 3), the vanes are aimed first toward one side of mat-forming zone 36 and then to the other side of said zone. As a result, there is little opportunity for channelization to occur and the particulate matter which is deposited on foraminous wires 45 and 46 is much more uniform.

The superiority of the present invention can clearly be seen from the nature of the material produced by the present apparatus according to the present process. As previously indicated, only relatively thick products could be obtained utilizing the prior art devices. For example, when a mixture of binder and mineral wool fiber was entrained in an air stream and conducted into the mat-forming zone described in U.S. Pat. No. 4,097,209, materials approximately one inch or more thick and having many areas of non-uniformity were obtained. Thick products can also be produced according to the present invention; however, they can be produced at high line speed, and they have none of the clumps or wave patterns inherent in the prior art products.

Figure 4:
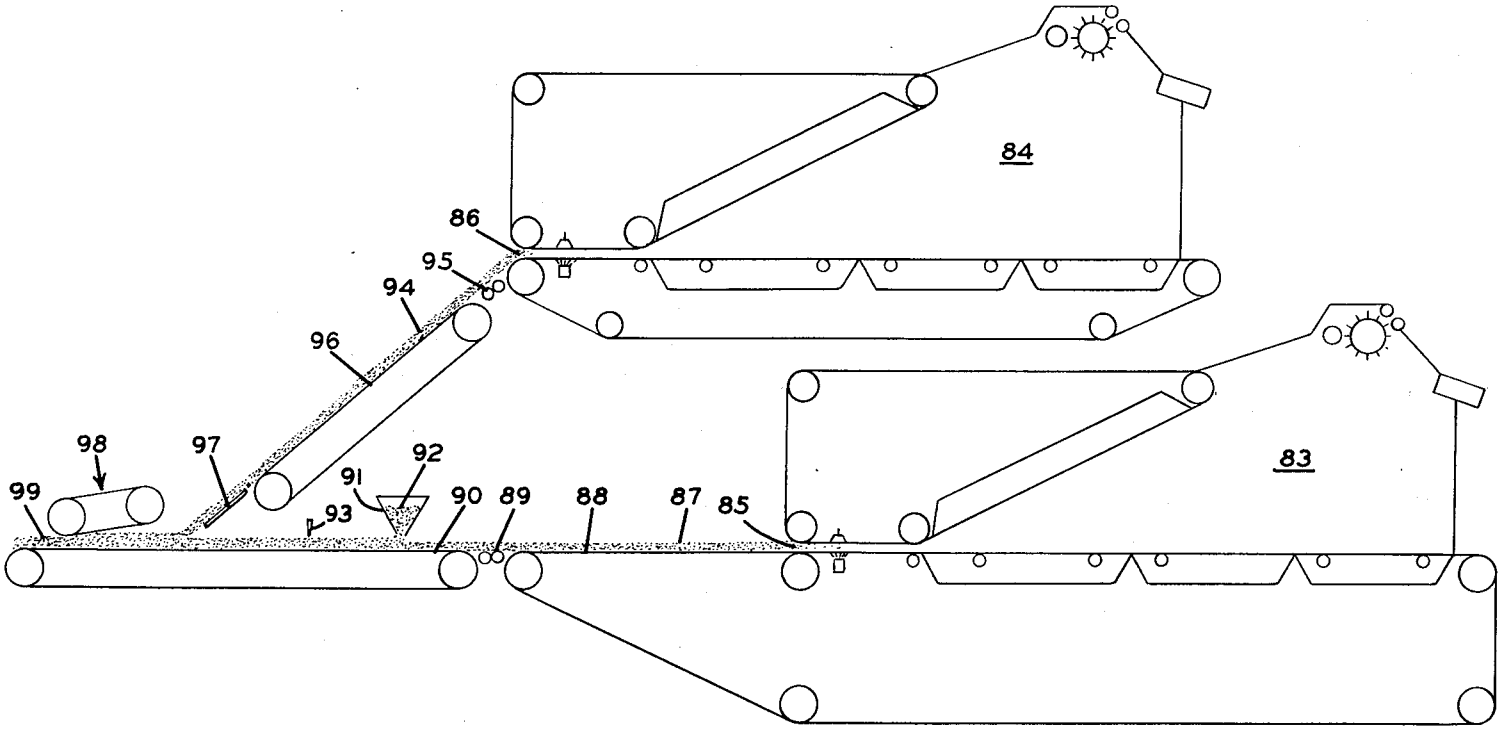
FIG. 4 illustrates apparatus comprising two mat-forming zones of the present invention.

As another example of the superiority of the present invention, attempts according to the prior art to obtain thinner materials were totally unsuccessful because of the clumps which were found in the final product. No such difficulties are encountered with the present invention. Indeed, non-woven webs having uniform basis weights and thin-gauge construction have been obtained using the present apparatus and practicing the present processes. The advantages of such thin layers of material are remarkable. For example, by utilizing two mat-forming zones as described herein, it is possible to form sandwich-like building products having thin outer skins and a center core. An example of such apparatus is illustrated in FIG. 4, in which the means for preparing the particulate mixture and the curing and finishing means are not shown.

Lower mat-forming zone 83 and upper mat-forming zone 84 are constructed as previously described and, as with the individual mat-forming zones, they may optionally comprise one or two foraminous wires. Each zone is provided with mixtures of binder and an appropriate fibrous material which are converted into webs of material as previously described. The webs emerge from zones 83 and 84 at opening nips 85 and 86, respectively. The lower web 87 is conveyed from conveyor 88 across transfer rolls 89 and onto conveyor 90. Core deposition station 91 then deposits core mixture 92 onto web 87, and screed 93 levels the core material. Station 91 comprises a gravimetric feeding device (not shown), such as that which has previously been described.

Meanwhile, upper web 94 emerges from opening nip 86, passes across transfer rolls 95 onto conveyor 96 and down slide tray 97 which deposits it on the top of the leveled core mixture. The loose composite may be compressed by pre-compression assembly 98, in which case it emerges from opening nip 99 as a structure which has sufficient strength to permit it to be conveyed through further processing and curing steps without sustaining significant damage.

A wide diversity of products may be obtained through the use of this apparatus. For example, if a mixture of expanded perlite and binder is used as the core mixture, the products produced can be varied from those having good acoustical properties to those having high modulus of rupture values. Further, the board is produced in a single pass operation which is unique. The prior art teaches that certain sandwich-like products may be produced by separately making the outer skins and adhering them to a core material using a layer of adhesive. The present invention is remarkably superior, not only because of its simplicity in avoidance of the adhesive layers, but also because the nature of the process permits a differential densification of the product to occur without resorting to separate laminating and pressing operations.

The aforementioned perlite cored product provides a particularly good example of this phenomenon. The outer layers of mineral wool and binder have a low compressive strength whereas the expanded perlite core has a relatively high compressive strength. When the composite structure is compressed, the core acts as an anvil against which the outer layers are compressed. This results in densification of the outer layers, but essentially no densification of the core. At the same time the core tends to accommodate any irregularities in the outer layers, thereby giving smooth outer surfaces with uniform density.

Another method of differentially densifying the composite structure involves the sequential curing of the core and the skins. For example, if a composite structure is prepared comprising a core having a binder that has a lower setting temperature than the binder for the skins, and the composite is passed through a through convection oven which is adjusted to a temperature that will cure the core binder but not the skin binder, a structure is produced having uncured skins. If these skins are then compressed against the core and cured, very dense skins can be produced. Similarly, the same effect can be obtained by using binders with similar setting characteristics, but excluding a necessary setting component from the skin binder. When the necessary component is subsequently added and the composite is compressed and cured, dense, hard skins are again obtained. An example of the latter alternative is the use of a binder such as a novalac phenol formaldehyde resin from which the cross-linking agent, hexamethylenetetramine, has been excluded.

These and a variety of other structures having diverse characteristics can be produced according to the present invention. Other advantages and attributes of the present invention will become even more apparent by reference to the examples which follow.

EXAMPLES

Example I

This example illustrates the preparation of a product comprising about 87% mineral wool and 13% powdered phenolic binder, the resulting product having a thickness of about 1.5 inches and a density of about 6 pounds per cubic foot. The product was prepared using apparatus having dual mat-forming zones such as those illustrated in FIG. 4. Identification numbers refer to the numbers used in the figures. The lower mat-forming zone 83 used for this and subsequent examples was constructed of plexiglass such that the distance between nip opening 47 and back panel 67 was about 109 inches, the zone width as measured between side panels 68 and 69 was about 26 inches, and the height as measured vertically between wire 45 and the center point of lickerin roll 42 was about 42 inches. The angle of nip opening 47 was about 25 degrees. Upper mat-forming zone 84 had a distance between nip opening 47 and back panel 67 of about 84 inches, the width and the height being about the same as for mat-forming zone 83. The angle at nip opening 47 was about 48 degrees.

For each mat-forming zone 83 and 84, mineral wool fibers were separated and fed onto conveyor 30 at a rate of 7.56 pounds per minute using a Vectroflo® gravimetric feeding device. The phenolic resin was fed onto the fibers through station 32 at a rate of 2.25 pounds per minute. This material was mixed together with fluffing roll 33 and fed to the respective fiberizing devices 34.

The wires in the respective chambers were converged at approximately 10 feet per minute and air was introduced to the respective chambers at a volume of approximately 5,000 cubic feet per minute while being exhausted through forming wires 45 and 46. The pressure inside each forming chamber was approximately 2.1 inches of water below atmospheric pressure, measured using a Dwyer gauge. In the lower forming chamber, approximately 90% of the entraining air was withdrawn through bottom forming wire 45, the majority of this air being withdrawn through exhaust means 62. In the upper forming chamber, approximately 60% of the air was exhausted through upper forming wire 46, no attempt being made to variably exhaust the air. Vanes 77 were oscillated within each aperture 44 at approximately 30 cycles per minute.

The matted materials were converged at nip openings 47 and consolidated in consolidation zones 48. Immediately prior to exiting from consolidation zones 48, the composite materials were simultaneously tamped using tamping devices 50 and exposed to anti-static devices 51. Tamping devices 50 were adjusted to strike the back side of wires 46 approximately 30 times per minute, causing the mats to be alternately compressed and released. These devices assisted in minimizing mechanical cling. Anti-static devices 51 were conventional alpha particle emitters which removed the charges from the fibrous mats and minimized static cling. When these devices were used separately or not used at all, full separation of the matted materials from the wires was not obtained. The simultaneous use of these devices, however, has given good separation, resulting in high quality products.

The individual webs emerging from mat-forming zones 83 and 84 were converged and pre-compressed using pre-compression assembly 98. This device was adjusted such that the nip opening contacted the consolidated web very lightly. The consolidated material was then passed into a through convection dryer (TCD) oven and exposed to air heated at about 400° F. for approximately three minutes. During this exposure time, the resinous binder melted and substantially cured. The distance between the pressure conveyors of the TCD oven was approximately 1.56 inches; therefore, when the board emerged from the TCD oven in a somewhat plastic condition, it was post-gauged and cooled. Post gauging adjusted the thickness of the board to about 1.5 inches and concurrent cooling with ambient air reduced the board temperature to somewhat less than 250° F. Product produced in this fashion without the use of a post-gauging device has been found to have a thickness variation of ±0.04 inches, whereas material produced using the post-gauging device has been shown to have a thickness variation of ±0.01 inch.

The acoustical performance of products formed in this manner was: noise isolation class (NIC) of 20 and noise reduction coefficient (NRC) of 95. Thus it was suitable for a variety of high performance acoustical applications.

Example II

This example illustrates the preparation of a sandwich-like product having an overall composition as follows:

| Ingredient | Weight Percent (solids basis) |
|---|---|
| Mineral wool | 24.21 |
| Powdered phenolic binder | 1.82 |
| Expanded perlite | 64.35 |
| Liquid phenolic resin | 9.62 |

The outer layers comprised 93% mineral wool and 7% powdered phenolic binder whereas the core mixture comprised 87% expanded perlite and 13% liquid phenolic resin.

Mineral wool fibers were fed onto conveyor 30 of upper and lower forming systems 83 and 84 at a rate of 2.47 pounds per minute. Powdered phenolic resin was then fed onto conveyor 30 via station 32 at a rate of 0.185 pounds per minute. This material was mixed together with fluffing roll 33 and fed to fiberizing devices 34 of each mat-forming zone. Except as noted below, the operating parameters were the same as those set forth in Example I.

The mineral wool binder compositions were fed into the respective mat-forming zones and felted onto foraminous wires 45 and 46 essentially as described in Example I. In this case, however, the air was exhausted at different rates through the foraminous wires in the lower chamber; thus, approximately 75% of the air was withdrawn through bottom forming wire 45 of zone 83 and approximately 25% was withdrawn through top forming wire 46. The static pressure in each of these chambers was approximately 1.8 inches of water below atmospheric pressure, measured using a Dwyer gauge.

The mats were converged at the respective nip openings 47, consolidated in compression zones 48, treated with tamping devices 50 and anti-static devices 51, and then conveyed toward pre-compression rolls 98. After the lower mat had been transferred onto conveyor 90, a mixture of 23% liquid phenolic resin and 77% expanded perlite was deposited via addition station 91 onto the lower mat at a rate of 0.87 pounds per square foot (wet basis). The core mixture was leveled with screed 93, combined with the upper mat 94, and consolidated using pre-compression rolls 98. The height of the pre-compression rolls at the incoming point was approximately 1.3 inches above conveyor 98 whereas at opening nip 99 the height was about 0.54 inches. This induced the emerging material to be extruded through the narrow nip opening. The thickness of the resulting pre-compressed composite was approximately 700 mils.

Pre-compression served to impart to the resulting uncured board sufficient strength and edge definition such that the board could be conveyed through succeeding preheating and curing operations without loss of perlite from the core or damage to the composite. After pre-compression, the board was transferred to a TCD device such as that illustrated in FIG. 1; however, the upper compression means were not used in preparing the cored product. The purpose of the TCD device was to preheat the cored product with a downward flow of air, thus causing substantial drying and curing of the core mixture while leaving the skins essentially uncured. Accordingly, the temperature of the air in the TCD oven remained below 300° F., a temperature at which the skin binder did not cure. Approximately a 2-minute period was used for preheating.

Following the preheating step, the board was cut into blanks and fed by a speed-up conveyor into a flatbed press. Because of the desired thickness of about 0.63 inch for the product, appropriate stops were used in the press to ensure that excessive compression did not occur. The final curing temperature was 450° F., although variations between 350° F. and 550° F. could be used. Dwell times in the press varied from about 15 seconds to about 15 minutes, although a compression time of 1 minute and 30 seconds gave good results at 450° F. Optionally, a band press could also have been used for the final curing and pressing steps.

The resulting board had an overall thickness of 0.63 inch and a density of 19.8 pounds per cubic foot. The approximate thickness of each of the upper and lower skins was 0.04 inch and the core thickness was 0.55 inch. The approximate density of the skin was 34.3 pounds per cubic foot whereas the core density was approximately 15.7 pounds per cubic foot.

Example III

This example illustrates the preparation of an embossed sandwich-like building board. The product was prepared in exactly the same manner described in Example II until the point where the uncured board emerged from precompression rolls 98. In this case, the material was conveyed into the TCD device and air was passed through the board from the bottom to the top. Because of the reverse flow, the upper compression means was adjusted to slightly touch the upper surface of the board to prevent it from lifting or buckling due to the upward pressure of the air stream. As a result of this treatment, curing occurred from the bottom of the board upwardly and the conditions were adjusted such that the curing was effected to within 1/16–¼ inch of the upper surface of the core material.

Following the preheating step, the board was cut into blanks and fed into a flat bed press, the upper platen of the press being equipped with an embossing plate. The pressure was adjusted such that the embossing plate penetrated only the upper, uncured region of the board. As described for Example II, a temperature of 450° F. was utilized for a dwell time of 1 minute 30 seconds. The density and basis weight values were essentially the same as for the product of Example II.

Example IV

This example illustrates the preparation of a sandwich-like product having a thin, high-density, moisture-resistant interior. The overall composition was as follows:

| Ingredients | Weight Percent (solids basis) |
|---|---|
| Mineral wool | 34.14 |
| Powdered phenolic binder | 6.10 |
| Cement grade perlite | 50.76 |
| Urea formaldehyde resin | 9.00 |

The outer layers comprised 85% mineral wool and 15% powdered phenolic binder whereas the core mixture comprised 85% cement grade perlite and 15% urea formaldehyde resin.

The board was prepared essentially as described in Example II; however, because the desired final gauge was 0.1875 inch, the stops in the precompressor were set at 0.1795 inch. The resulting board had a density of 42 pounds per cubic foot and a basis weight of 0.656 pounds per square foot. The weight of the outer skins was 0.264 pounds per square foot.

Example V

This example illustrates the preparation of a damage resisant board containing fiberous wood material. The overall composition of the board was as follows:

| Ingredients | Weight Percent (solids basis) |
|---|---|
| Mineral wool | 22.17 |
| Powdered phenolic binder | 3.87 |
| Expanded perlite | 48.10 |
| Debarked aspen wood fiber | 11.08 |
| Liquid phenolic resin | 14.78 |

This board was produced in the same fashion described in Example II to give a product having a thickness of 0.625 inch and a density of 19.8 pounds per cubic foot. The total weight of the outer skins was 0.269 pounds per square foot. The presence of the wood fiber in this product had the effect of increasing the board's toughness while reducing the effects of damaging impact.

Example VI

This example, in which two alternative modifications are described, further illustrates the technique of sequential curing. The basic procedure was comparable to that used in Example II except that (1) the phenolic resin contained no hexamethylenetetramine curing agent and (2) the previously used core binder was replaced by a starch powder.

The overall composition of the board, calculated on a dry basis, was as follows:

| Ingredient | Weight Percent (solids basis) |
|---|---|
| Mineral wool | 24.21 |
| Powdered novalac phenolic binder plus hexamethylenetetramine | 1.82 |
| Expanded perlite | 64.35 |
| Powdered starch binder | 9.62 |

The outer layers comprised 93% mineral wool and 7% binder, based on the above proportions of the ingredients, whereas the dry core mixture comprised 87% expanded perlite and 13% powdered starch.

The upper and lower skins were produced as described in Example II, except that the powdered binder was added at a rate of 0.17 pounds per minute due to the absence of the curing agent. Prior to adding the core mixture, it was moistened with water at a level of 19% based on the weight of the wet mixture. The moistened core mixture was then added via core deposition station 91 at a level of 0.98 pounds per square foot, the difference from the quantity set forth in Example II being due to the added moisture.

After the added material was leveled with screed 93, the composite materials were consolidated with the upper mat using precompression rolls 98. The composite material was then transferred to a TCD device which, unlike the device in Example II, was provided with a steaming apparatus. The steaming apparatus was located at the entrance of the TCD device and consisted of a steam manifold located above the board and a vacuum device located beneath the board, under the TCD conveyor. As the board passed into the TCD oven, the steaming device was used to draw steam into the board at a rate sufficient to raise the temperature of the water in the core mixture above 180° F., thus causing the starch to gel. The board proceeded through the TCD device where the core was dried and preheated in the usual manner. However, in this instance, it was possible to use temperatures in excess of 300° F. because the binder in the skins did not contain the curing agent.

Following the gelling and drying steps, the board was cut into blanks and fed into a spray booth. In this booth, a 10% solution of hexamethylenetetramine was applied to the upper and lower faces of the board at a rate of 6 grams per square foot. The board was then fed by a speed up conveyor to a flatbed press and cured as described in Example II. Under the action of the press, the hexamethylenetetramine degraded to liberate the formaldehyde curing agent, thereby curing the resin. The physical characteristics of the board were essentially the same as those measured for the product of Example II.

Embossed products may also be prepared in the same manner and they provide the added advantage of avoiding the partial precuring step as set forth in Example III. Thus, when the upper and lower skins are cured in the presence of the hexamethylenetetramine solution, the water which vaporizes softens the starch core binder, thereby permitting it to be reformed in a desirable embossed shape.

This invention is not restricted solely to the descriptions and illustrations provided above, but encompasses all modifications envisaged by the following claims.

I claim:

1. A process for forming a non-woven web, said process comprising the steps of preparing a mixture comprising a binder and principally inorganic fibrous material;

introducing said mixture into the upper regions of a mat-forming zone comprising a first moveable foraminous wire disposed in the lower region thereof and, optionally, a second moveable foraminous wire disposed so as to converge with said first foraminous wire at a nip opening disposed therebetween, said mixture being introduced through a first aperture such that it falls into and is entrained in a horizontally or upwardly directed air stream which is introduced through a second aperture into said mat-forming zone, said second aperture having means associated therewith for controlling the direction of the air which passes therethrough;

adjustably exhausting the entraining air through said wire or wires to selectively deposit said mixture thereupon, said second aperture and said optional second foraminous wire being disposed relative to said first foraminous wire such that the mixture which is deposited on said wire or wires is deposited essentially uniformly;

consolidating said deposited mixture to yield a non-woven web of material; and compressing and curing said material.

2. The invention as set forth in claim 1 hereof wherein said optional second foraminous wire is replaced by a panel of non-conductive material.

3. The invention as set forth in claim 1 hereof wherein said optional second foraminous wire is replaced by a non-foraminous wire.

4. The invention as set forth in claims 1, 2 or 3 hereof wherein said air is exhausted through said first foraminous wire using multiple exhaust means.

5. The invention as set forth in claims 1, 2 or 3 hereof wherein said means for controlling the air which passes through said second aperture comprises a vane assembly.

6. The invention as set forth in claims 1, 2 or 3 hereof wherein an antistatic device is used to facilitate separation of said consolidated material from said wire or wires.

7. The invention as set forth in claims 1, 2 or 3 hereof wherein a tamping device is used to facilitate separation of said consolidated material from said wire or wires.

8. The invention as set forth in claims 1, 2 or 3 hereof wherein the angle at said nip opening is not less than about 20° and not more than about 55°.

9. A process for forming a building board comprising a core material and non-woven outer surfaces, said process comprising the steps of preparing a first mixture and a second mixture comprising a binder and principally inorganic fiberous material;

introducing said first mixture into the upper regions of an upper mat-forming zone and said second mixture into the upper regions of a lower mat-forming zone, each said mat-forming zone comprising a first moveable foraminous wire disposed in the lower region thereof and, optionally, a second moveable foraminous wire disposed so as to converge with said first foraminous wire at a nip opening disposed therebetween, each said mixture being introduced through a first aperture such that it falls into and is entrained in a horizontally or upwardly directed air stream which is introduced through a second aperture into each said mat-forming zone, said second apertures having means associated therewith for controlling the direction of the air which passes therethrough;

adjustably exhausting the entraining air through said first foraminous wires and said optional second foraminous wires to selectively deposit said mixtures thereupon, said second apertures and said optional second wires being disposed relative to said first foraminous wires such that the mixtures which are deposited on said wires are deposited essentially uniformly;

consolidating the deposited mixtures to provide upper and lower webs of material;

depositing a core mixture comprising a filler and a binder on said lower web of material;

consolidating the resulting layered material with said upper web to provide a composite structure; and compressing and curing said composite structure.

10. The invention as set forth in claim 9 hereof wherein said optional second foraminous wire in either or both of said upper and lower mat-forming zones is replaced by a panel of non-conductive material.

11. The invention as set forth in claim 9 hereof wherein said optional second foraminous wire in either or both of said upper and lower mat-forming zones is replaced by a non-foraminous wire.

12. The invention as set forth in claims 9, 10 or 11 hereof wherein said air is exhausted through said first foraminous wires using multiple exhaust means.

13. The invention as set forth in claims 9, 10 or 11 hereof wherein said means for controlling the air which passes through said second apertures comprises a vane assembly.

14. The invention as set forth in claims 9, 10 or 11 hereof wherein an antistatic device is used to facilitate separation of either or both of said consolidated upper and lower non-woven webs of material from said wires.

15. The invention as set forth in claims 9, 10 or 11 hereof wherein a tamping device is used to facilitate separation of either or both of said consolidated upper and lower non-woven webs of material from said wires.

16. The invention as set forth in claims 9, 10 or 11 hereof wherein the angle at said nip opening in each said mat-forming zone is not less than about 20° and not more than about 55°.

17. The invention as set forth in claims 9, 10 or 11 hereof wherein said filler in said core mixture is expanded perlite.

18. The invention as set forth in claims 9, 10 or 11 hereof wherein said composite structure is sequentially cured.

19. The invention as set forth in claim 18 hereof wherein said core mixture is cured at a temperature at which the binder in said non-woven webs remains essentially uncured.

20. The invention as set forth in claim 18 hereof wherein the binder in said non-woven webs lacks a curing component, said webs remaining uncured when said core material is cured, the curing component for said webs being subsequently added prior to curing said webs.

* * * * *